US005933696A

United States Patent [19]

Howard et al.

[11] Patent Number: 5,933,696

[45] Date of Patent: Aug. 3, 1999

[54] PHOTORECEPTOR WITH INTERNAL WASTE TONER CONTAINER

[75] Inventors: Alan C. R. Howard, Westoning; Edward J. Byrne, Welwyn Garden City; Raymond A. Harvey, St. Albans; Chistopher Pearce, Stevenage; Roger D. Masham, Ashwell; Anilkumar G. Bhagwat, Hemel Hempstead, all of United Kingdom

[73] Assignee: Xerox Corporation, Stamford, Conn.

[21] Appl. No.: 08/911,243

[22] Filed: Aug. 15, 1997

[30] Foreign Application Priority Data

Nov. 30, 1996 [GB] United Kingdom ..... 9625026

[51] Int. Cl.[6] ..... G03G 21/12; G03G 21/10

[52] U.S. Cl. ..... 399/360; 399/117; 399/358

[58] Field of Search ..... 399/159, 358, 399/360, 116, 117; 355/298

[56] References Cited

U.S. PATENT DOCUMENTS

| | | | |
|---|---|---|---|
| 4,400,077 | 8/1983 | Kozuka et al. | 399/117 |
| 4,914,478 | 4/1990 | Yashiki | 399/117 |
| 5,052,090 | 10/1991 | Kitaura et al. | 399/159 X |
| 5,119,994 | 6/1992 | Placzek | 241/17 |
| 5,341,200 | 8/1994 | Thomas | 399/111 |
| 5,461,464 | 10/1995 | Swain | 399/159 |
| 5,521,678 | 5/1996 | Riehle et al. | 399/159 |
| 5,576,803 | 11/1996 | Williams et al. | 399/116 |
| 5,649,267 | 7/1997 | Aerens et al. | 399/159 |
| 5,652,077 | 7/1997 | Obinata | 399/159 X |
| 5,729,792 | 3/1998 | Ikehara | 399/116 X |
| 5,771,425 | 6/1998 | Yamada et al. | 399/116 X |
| 5,778,296 | 7/1998 | van der Steen et al. | 399/360 |

FOREIGN PATENT DOCUMENTS

| | | | |
|---|---|---|---|
| 56-52786 | 5/1981 | Japan | 355/398 |
| 61-114275 | 5/1986 | Japan | 355/298 |
| 63-85684 | 4/1988 | Japan | 355/298 |
| 1-134387 | 5/1989 | Japan | 355/298 |
| 4-56986 | 2/1992 | Japan | 355/298 |
| 4-127186 | 4/1992 | Japan | 355/298 |

*Primary Examiner*—S. Lee

[57] ABSTRACT

A photoreceptor assembly and a xerographic cassette for a printing or copying machine, the cassette including a photoreceptor drum, a drum cleaner, a waste toner container, for storing waste toner; and a waste toner conveyor for conveying waste toner cleaned off said photoreceptor drum by the cleaner into the waste toner container characterized in that the waste toner container is positioned in the interior of the photoreceptor drum and is reversibly removable therefrom. The conveyor typically includes a flexible helical wire which acts as an auger. Once filled with waste toner, the waste toner container is removed from the drum and is replaced by a fresh container.

5 Claims, 5 Drawing Sheets

PHOTORECEPTOR WITH INTERNAL WASTE TONER CONTAINER

This invention relates to a photoreceptor assembly and xerographic cassette for a printing or copying machine, and is particularly concerned with such a cassette which includes a photoreceptor drum, a device for cleaning excess toner from the photoreceptor drum and a container for the waste toner.

In xerographic printing and copying machines, it is commonplace to use a xerographic cassette which contains at least the photoreceptor, so that when the photoreceptor, or any other xerographic process item contained within the cassette, needs replacement, it can easily be replaced by simply removing the cassette and exchanging it for a new one. The cassette can be replaced either by the customer (a Customer Replaceable Unit or CRU) or by a service engineer (an Engineer Replaceable Unit or ERU).

In the xerographic process, after the development of an electrostatic latent image with dry toner particles and the transfer of the developed image to a sheet of copy paper, any toner remaining on the photoreceptor surface is cleaned off by a suitable cleaning device. The cleaning device typically comprises a polyurethane cleaning blade. The cleaned off toner can then either be recirculated or stored for subsequent disposal. In general, better quality images are obtained by employing the latter technique, since fresh toner is always used for the development of images. Indeed, the cleaned off toner, which is often contaminated by undesirable debris, such as paper fibers is usually regarded as waste. The storage of waste toner presents problems however, in that a storage means needs to be provided, together with suitable means for delivering the waste toner to the container. In small machines space is at a premium, and a container for waste toner is not always easy to accommodate. One way of providing space for waste toner is to use the interior of the photoreceptor, which is a space that is otherwise substantially unused. In the case of a printer or copier using a cassette, this has the advantage that when the cassette is at the end of its useful life, it can be removed for disposal or recycling, taking the waste toner with it. Generally, when the interior of the photoreceptor drum becomes filled with waste toner a "replace cassette" warning is triggered, followed by a machine shutdown. In many cases however, the cassette becomes full of toner at a point when the individual elements of the cassette, in particular the photoreceptor drum element, are only about half way through their useful lives. Thus, cassettes can potentially be replaced at a point in time when they are still usable solely because of the need to empty out the collected waste toner from the interior of the photoreceptor drum.

The Applicants have now found that the above described problem can be solved if the cavity defined by the photoreceptor drum is provided with a removable insert container capable of receiving and storing waste toner. Thus, a new cassette would be supplied with a photoreceptor including an empty insert container. As the copying or printing machine is used the container progressively fills up with waste toner. When the container is full, it is removed from the photoreceptor drum and replaced by a second empty container. Thus, the photoreceptor may be used until the end of its natural lifetime, rather than having to be replaced solely because of the fact that it is filled with collected waste toner.

U.S. Pat. No. 5,341,200 to Thomas discloses a removable process unit for an electrostatographic printing machine that has a photoreceptor, a frame with a longitudinal axis to movably mount the photoreceptor therein parallel to the longitudinal axis, a cleaning sump that extends parallel to the longitudinal axis and adjacent the photoreceptor, a toner transport to transport toner cleaned from the photoreceptor toward one end of the sump with the toner sump having an aperture at one end, and a cover for the frame at the one end thereof, the cover including a cavity with an aperture in communication with the aperture in the sump for storage of cleaned toner.

U.S. Pat. No. 5,119,994 describes an apparatus and method for processing medical waste materials comprising an elongate pressure vessel of generally cylindrical configuration having an inlet end, and a closely fitting closure member for the inlet. An elongate drum of generally cylindrical configuration is mounted in the vessel for rotation about is longitudinal axis, which drum can be selectively driven in either rotative direction. The longitudinal axis of the drum is disposed at a slight angle of incline to the horizontal, placing the inlet end at a slightly higher elevation than the opposite end. A helically configured member is disposed along the interior perimeter of the drum, such that during rotation of the drum in a first rotative direction, the helically configured member moves the waste material in a direction away from the inlet end of the drum, whereas during rotation of the drum in the second rotative direction, the helically configured member moves the waste material toward the inlet. The helically configured member is utilized in conjunction with a plurality of non-obstructive lifting paddles that serve to effect a highly advantageous, very thorough mixing of the waste materials. Moisture and heat are typically utilized to aid the processing of the waste, such as the addition of stem. Discharge of the fully processed waste material is effected when the drum is being rotated in the second rotative direction, after the closure member has been opened.

Copending U.S. Pat. No. 5,778,296 discloses a xerographic cassette for a printing or copying machine includes a photoreceptor drum a cleaning blade and waste toner conveying means for conveying waste toner, cleaned off the photoreceptor drum by the cleaning blade, into the interior of the photoreceptor drum by the cleaning blade, into the interior of the photoreceptor drum for storage. The conveying means includes a flexible helical wire which acts as an auger. A curved tube portion of the conveying means passes through an auxiliary waste toner container. Once the auxiliary container is substantially full, waste toner is conveyed into the interior of the photoreceptor drum. The auxiliary container is provided with access means to enable it to be emptied, thereby prolonging the useful life of the cassette.

SUMMARY OF THE INVENTION

Briefly stated, and in accordance with one aspect of the present invention there is provided a photoreceptor assembly for use in a xerographic cassette comprising a photoreceptor drum having an interior; and a waste toner container being accessible via a waste toner conveying means, the waste toner container being positioned in the interior of the photoreceptor drum for reversible removal therefrom.

Pursuant to another aspect of the present invention there is provided a xerographic cassette for a printing and a copying machine, the xerographic cassette comprising: a photoreceptor drum having waste toner thereon means for cleaning the photoreceptor drum; a waste toner container for storing the waste toner removed from the photoreceptor drum having an interior; and means for conveying the waste toner removed from the photoreceptor drum by the cleaning means into the waste toner container, the waste toner container being positioned in the interior of the photoreceptor drum being reversibly removable therefrom.

DETAILED DESCRIPTION OF THE INVENTION

The xerographic cassette herein is suitable for use in a printing or copying machine. The cassette includes a photoreceptor drum which typically comprises a metal cylinder of diameter from 5 to 100 cm, and length from 10 to 100 cm. At each end of the cylinder there are generally provided end caps and mounting assemblies to enable mounting of the drum to the cassette, such that the drum may be rotated about its principal axis when mounted in the cassette. The outer surface of the photoreceptor drum is coated with charge generating and/or charge generating materials, as are well known in the art. A drum cleaning means is provided for cleaning waste toner from the outer surface of the photoreceptor drum. The cleaning means, for example, comprises a flexible blade member. A waste toner conveying means is also provided for conveying waste toner cleaned from the photoreceptor drum by the cleaning means to a waste toner container. The term 'container' herein is used in its functional sense, and encompasses both rigid and flexible container structures. A preferred conveying means comprises an auger, as described in more detail herein.

The waste toner container is positioned in the interior of the photoreceptor drum and is reversibly removable therefrom. In a preferred aspect, the waste toner container is reversibly fixed within the interior of the photoreceptor drum such that it does not move relative to the photoreceptor drum when the drum rotates. In an alternate preferred aspect, the waste toner container reversibly engages the interior surface of the photoreceptor drum, such that as the drum rotates the waste toner container rotates also.

In another preferred aspect the container is shaped such that, when positioned, a plurality of outer edges of the container engage the interior surface of the photoreceptor. In another highly preferred aspect the container is itself essentially cylindrical in shape and of a size such that, when positioned, the outer surface of the cylindrical container engages with the inner surface of the photoreceptor drum.

Figure 1:
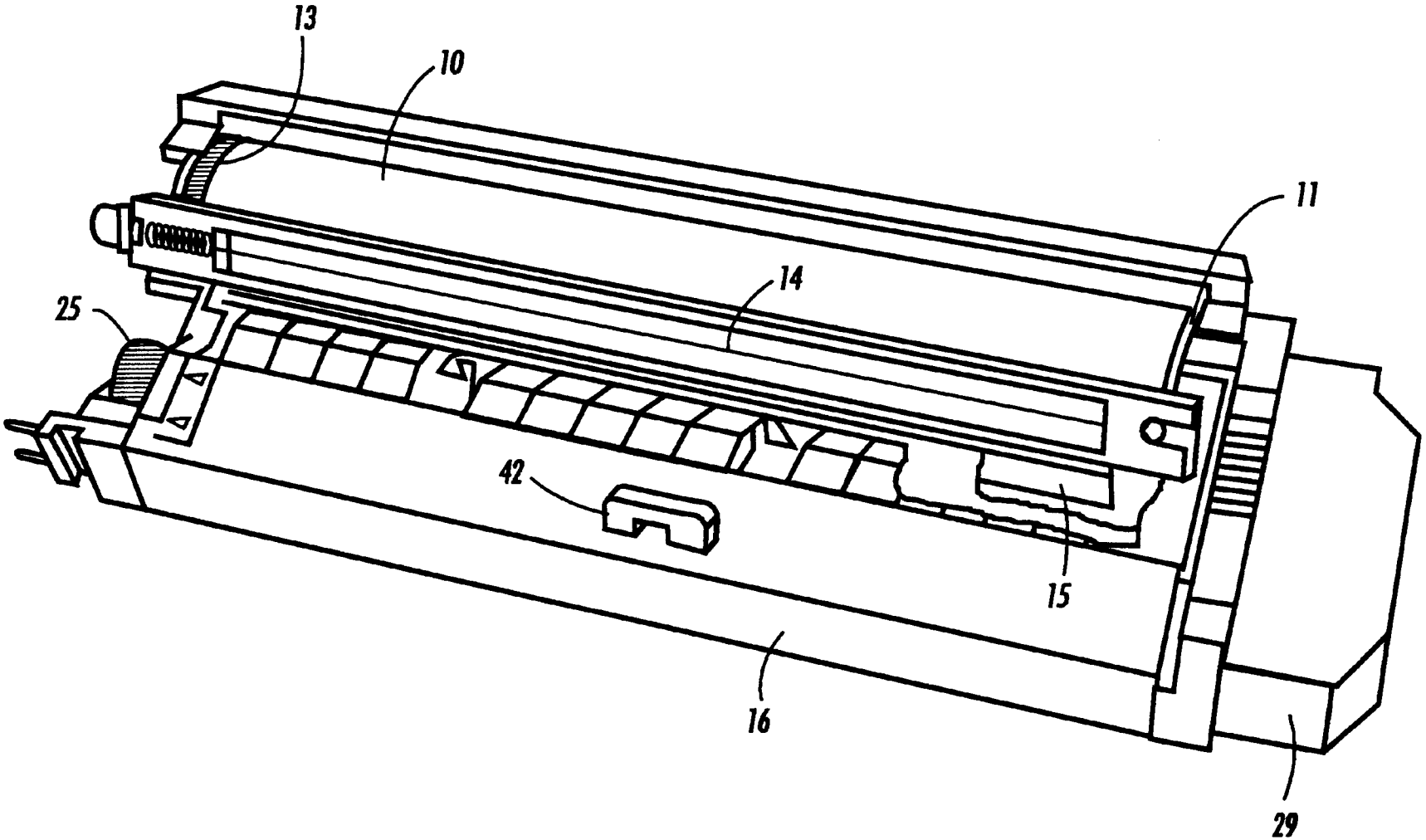
FIG. 1 is a perspective view, from above, of a xerographic cassette incorporating the invention.
Figure 2:
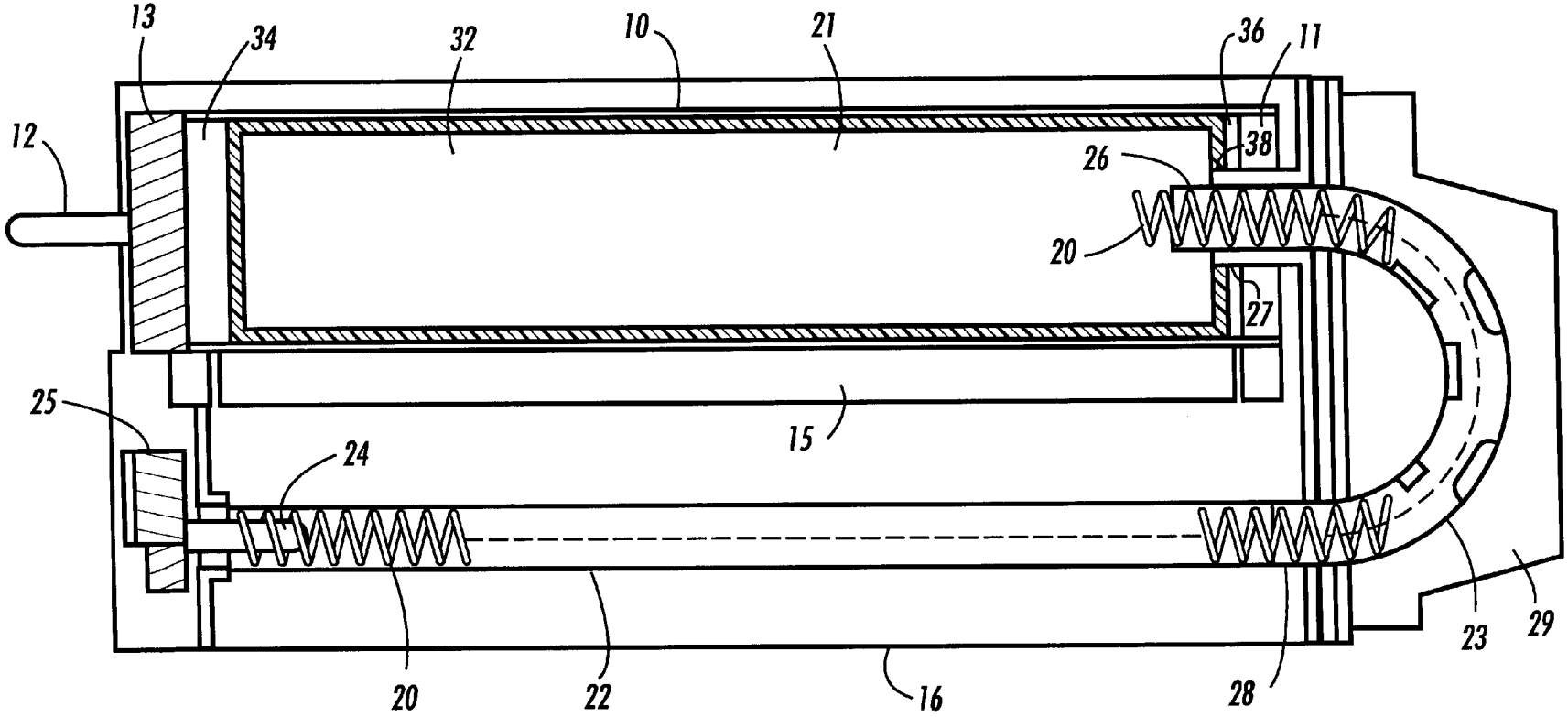
FIG. 2 is a simplified, diagrammatic plan view, partly in section, of the xerograpic cassette of FIG. 1.

Referring to FIGS. 1 and 2, an embodiment is shown in which the xerographic cassette includes a photoreceptor drum 10 which is mounted for rotation in the cassette by a mounting assembly comprising a locating shaft 12, which is centered on the rotational axis of the drum, and an end cap 13 having a flanged edge with gear teeth which enable the drum to be rotationally driven by a motor (not shown) in the printing or copying machine. The locating shaft 12 engages in a suitable second bearing (not shown) within the printer or copier which receives the cassette. The other end of the drum 10 is provided with an end cap 11 having a centrally located aperture adapted to receive a sleeve front bearing 27, which supports this end of the drum 10 for rotation. In addition to the photoreceptor drum 10, the cassette includes a corotron 14 and a cleaning device which has a cleaning blade 15 mounted within a cleaner housing 16. The cleaning blade 15, which may be, for example, of polyurethane material, engages the surface of the photoreceptor drum 10 so that as the photoreceptor drum rotates, waste toner is scraped off the drum surface and falls into the cleaner housing 16.

Waste toner which has fallen into the cleaner housing 16 is conveyed by means of an auger 20 into a waste container 30 positioned in the interior 21 of the photoreceptor drum 10. The auger consists of a helical spring wire which runs in a part-cylindrical channel 22 in the bottom of the cleaner housing 16, and also extends through a curved tube 23 which turns through an angle of about 180 degrees, to link the end of the channel 22 with the interior 21 of the photoreceptor drum. The auger 20 terminates beyond the end of the tube 23 and thus within the interior 21 of the drum. The auger 20 is driven, at its end remote from the curved tube 23, by a drive shaft 24 which in turn is driven from a drive within the printer or copier through a gear wheel 25. The end 26 of the curved tube 23 within the drum 10 passes through the first end cap 11 of the drum, within the sleeve bearing 27, and is centered on the rotational axis of the drum. The sleeve bearing 27 includes a seal which prevents the escape of toner. The other end 28 of the curved tube 23 is secured into the end wall of the cleaner housing 16.

As the auger 20 rotates during operation of the printer or copier that uses the cassette, cleaned off waste toner falls to the bottom of the cleaner housing 16, from where it is conveyed, along channel 22, towards the end 26 of curved tube 23. The tube 23 is enclosed within the cassette by a detachable casing 29. Once inside the tube 23, the toner is conveyed around the tube 23 to the waste toner container 30 located in the interior 21 of the photoreceptor drum 10. The container 30 has an outer surface 32, which engages with the inner surface of the photoreceptor drum, and opposing end walls 34 and 36. An inlet 38 is provided to one end wall 36 through which the end 26 of the curved tube 23 is snugly inserted to allow conveyance of toner to the interior of the waste container 30. Thus, as the cassette is used, waste toner gradually accumulates in the cylindrical waste container 30. Toner conveyed into the waste container 30 in this way will tend to distribute itself evenly within the waste container 30 due to the rotation of the drum 10.

Figure 3:
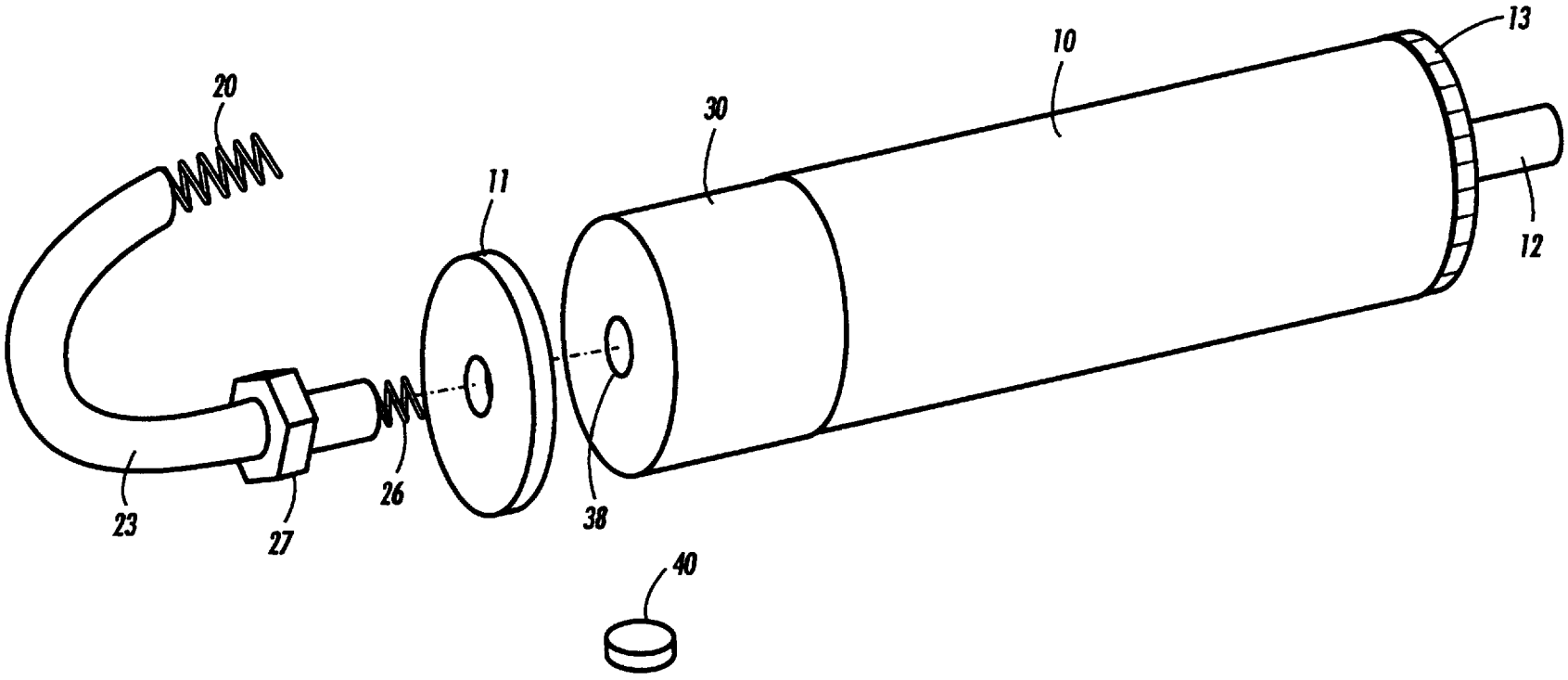
FIG. 3 is an exploded perspective view of a photoreceptor drum, waste container and conveying means in accord with the present invention.

Eventually, the waste toner container 30 becomes substantially full, and the toner starts to build up in the cleaner housing 16, eventually actuating a switch 42 (FIG. 1) that sends a "replace waste container" signal to the printer or copier, and leading to a machine shutdown signal. Replacement is enabled by first removing the cassette from the machine and holding it upright such that the inlet 38 of the waste container 30 faces in an upwards direction. The detachable casing is removed to expose the tube 23. The end 26 of the tube 23 is then withdrawn from the inlet 38 of the waste container 30 and the sleeve bearing 27 is detached from the end cap 11 of is the drum 10. In an improvement to the present embodiment, as shown in FIG. 3., the sleeve bearing 27 is fixedly attached to the tube 23, such that when the end 26 of the tube 23 is removed from the inlet 38 the sleeve bearing 27 is concurrently removed. The inlet 38 is plugged with a plug 40 to prevent spillage of waste toner. A plug would typically be supplied with a fresh (i.e. replacement) waste toner container. The locating shaft 12 at the other end of the drum 10 is dismounted from its bearing mounting (not shown) and the drum 10 thereby removed from the cassette. The end cap 11 is removed, thereby enabling the full waste toner container 30 to be withdrawn from the interior of the photoreceptor drum 10 and substituted by a fresh container 30. The drum 10 is then remounted onto the cassette, the end cap 11 and sleeve bearing 27 attached to the drum 10, and tube 23 inserted into the inlet 38 of the fresh waste container 30. The cassette is then put back into the machine.

Figure 4:
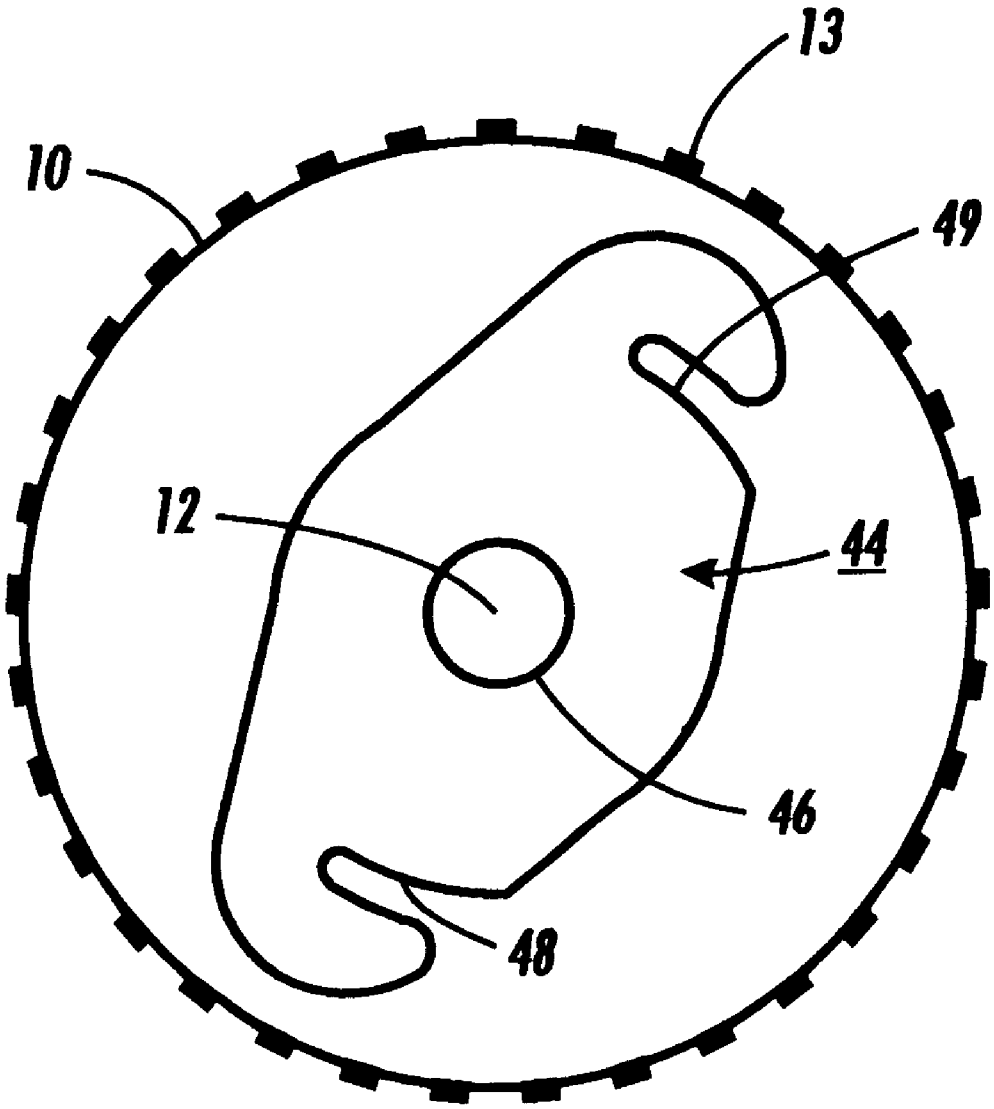
FIG. 4 is an plan view of one end of a photoreceptor drum and a bearing for mounting of the drum to a xerographic cassette.

In an improvement to the photoreceptor drum herein, FIG. 4 shows a readily dismountable bearing 44 arrangement in combination with the flanged second end cap 13 of the drum 10. The bearing 44 comprises a planar sheet of thickness 2 mm, having an essentially ovular shape with a central aperture 46 for receipt of the locating shaft 12. Two curved slits 48, 49 are present in the edges of the sheet at positions separated from each other by a 180° rotation about an axis defined by central aperture 46, such that the bearing 44 adopts the shape of the letter "s". The slits 48,49 are adapted to receive screw mounting pins located on the body of the cassette (not shown) for readily reversible mounting of the bearing 44 and drum 10 to the body of the cassette.

Figure 5A:
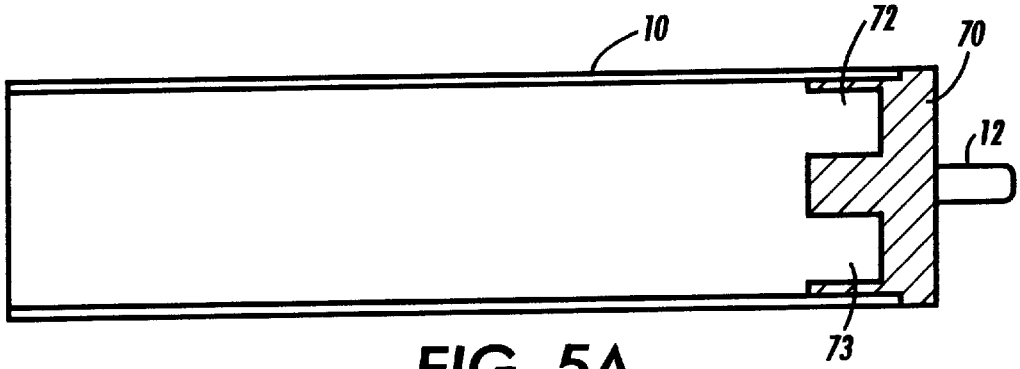
FIG. 5A and 5B show in sectional plan view a photoreceptor drum and waste toner container in accord with the present invention.
Figure 5B:
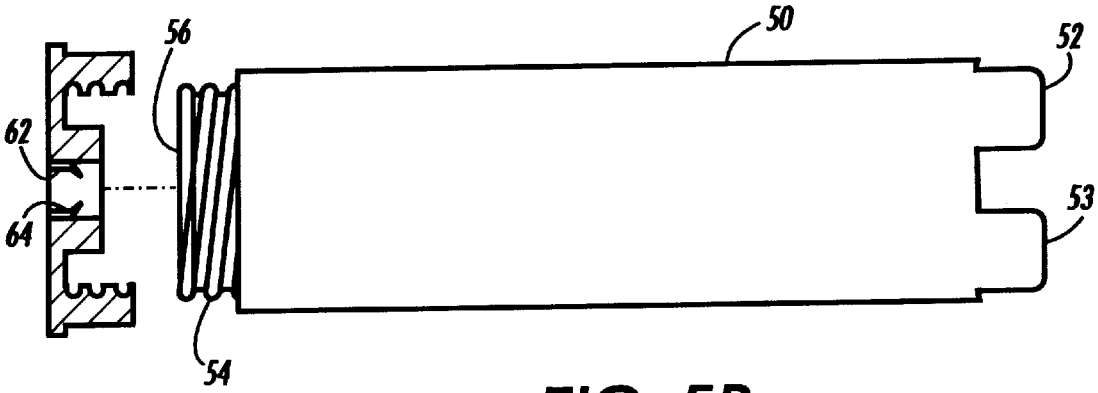

FIGS. 5A and 5B show a further embodiment of the photoreceptor and waste toner assembly of the present invention comprising drum (FIG. 5A) and waste toner container, and end cap (FIG. 5B) elements. The waste toner container 50 is an essentially cylindrical 'blow molded' plastic bottle having at one end a threaded rim 54 defining an opening 56. The base of the container 50 is provided with lugs 52,53 shaped such as to engage for rotation with receiving cavities 72, 73 present in the flanged second end cap 70 of the photoreceptor drum. The threaded rim 54 of the container 50 is adapted to screw into a threaded bearing cap 60. The threaded bearing cap 60 is provided with an aperture 62 for reversibly receiving a tube and auger (not shown). The aperture 62 is provided with a self-sealing valve 64 to ensure no spillage of retained toner when the auger and tube are withdrawn from the aperture 62.

With the embodiment of FIGS. 5A and 5B, replacement of a full waste container is enabled by first removing the cassette from the machine and holding it upright such that the inlet 56 of the full waste toner container 50 faces in an upwards direction. The detachable casing is removed to expose the tube and auger arrangement (not shown). The end of the tube and auger is withdrawn from the aperture 62 of the threaded bearing cap 60. The drum 10 is then dismounted from its second bearing (not shown) and removed from the cassette with its threaded bearing cap 60 still in place. Holding the drum 10 such that the full waste container 50 is upright, the threaded bearing cap 60 is then unscrewed from the full waste container 50. A cap (not shown) is screwed onto the full waste toner container to prevent spillage of toner. The full waste container 50 is then withdrawn from the interior of the photoreceptor drum 10 and is generally substituted by a fresh container 50. Alternatively, the full waste container 50 is cleaned out, for example by vacuum cleaning, to remove its waste toner content and the cleaned out container is reused. The threaded bearing cap 60 is then replaced, the drum 10 is remounted onto the cassette, and tube and auger reinserted into the threaded bearing cap 60. The cassette is then put back into the machine.

In recapitulation, the present invention utilizes a xerographic cassette that contains a photoreceptor drum with an interior for holding a waste toner collection container. A cylindrical tube collects the waste toner removed from the surface of the photoreceptor drum and augers the toner to the waste toner collection container. When full, the waste toner container is removed from the photoreceptor drum and replaced with an empty waste toner container without having to replace the photoreceptor drum before completion of its natural lifetime of use.

It is, therefore, apparent that there has been provided in accordance with the present invention, a xerographic cassette and photoreceptor assembly that fully satisfies the aims and advantages hereinbefore set forth. While this invention has been described in conjunction with a specific embodiment thereof, it is evident that many alternatives, modifications, and variations that fall within the spirit and broad scope of the appended claims.

It is claimed:

1. A photoreceptor assembly for use in a xerographic cassette comprising:

a photoreceptor drum having an interior; and a waste toner container being accessible via a waste toner conveying means, said waste toner container being positioned in the interior of said photoreceptor drum for reversible removal therefrom, said waste toner container being cylindrical in shape having an outer surface that engages with an inner surface of said photoreceptor drum, and further, wherein said photoreceptor drum includes a first end cap and a second end cap, one of said end caps having an opening to allow access of the waste toner conveying means to said waste toner container.

2. A photoreceptor assembly for use in a xerographic cassette comprising:

a photoreceptor drum having an interior; and a waste toner container being accessible via a waste toner conveying means, said waste toner container being positioned in the interior of said photoreceptor drum for reversible removal therefrom, and further, wherein said photoreceptor drum includes a first end can and a second end cap, one of said end caps having an opening to allow access of the waste toner conveying means to said waste toner contain, said first end cap comprising an internally threaded bearing cap; and said waste container having an opening defined by a threaded rim, said threaded rim for engaging said internally threaded bearing cap.

3. An assembly as recited in claim 2, wherein said waste toner container having lugs and said second end cap having receiving cavities, said lugs engaging said receiving cavities for rotation of said second end cap.

4. A photoreceptor assembly for use in a xerographic cassette comprising:

a photoreceptor drum having an interior; and a waste toner container being accessible via a waste toner conveying means, said waste toner container being positioned in the interior of said photoreceptor drum for reversible removal therefrom, wherein said waste toner container reversibly engages said photoreceptor drum, said photoreceptor drum rotates as said waste toner container also rotates.

5. A photoreceptor assembly for use in a xerographic cassette comprising:

a photoreceptor drum having an interior; and a waste toner container being accessible via a waste toner conveying means, said waste toner container being positioned in the interior of said photoreceptor drum for reversible removal therefrom, wherein said waste toner container being reversibly fixable within the interior of said photoreceptor drum such that upon rotation of said photoreceptor drum, said waste toner container remains stationary relative to said Photoreceptor drum.

* * * * *